US011250807B2

(12) United States Patent
Choi

(10) Patent No.: US 11,250,807 B2
(45) Date of Patent: Feb. 15, 2022

(54) DRIVER INTEGRATED CIRCUIT AND DISPLAY DRIVING DEVICE INCLUDING THE SAME

(71) Applicant: SILICON WORKS CO., LTD., Daejeon (KR)

(72) Inventor: Kee Joon Choi, Daejeon (KR)

(73) Assignee: SILICON WORKS CO., LTD., Daejeon (KR)

( * ) Notice: Subject to any disclaimer, the term of this patent is extended or adjusted under 35 U.S.C. 154(b) by 0 days.

(21) Appl. No.: 17/116,348

(22) Filed: Dec. 9, 2020

(65) Prior Publication Data

US 2021/0193075 A1 Jun. 24, 2021

(30) Foreign Application Priority Data

Dec. 23, 2019 (KR) ..... 10-2019-0172904

(51) Int. Cl.
*G09G 3/36* (2006.01)

(52) U.S. Cl.
CPC ... *G09G 3/3696* (2013.01); *G09G 2310/0289* (2013.01); *G09G 2310/0291* (2013.01); *G09G 2310/0294* (2013.01); *G09G 2310/08* (2013.01)

(58) Field of Classification Search
CPC ..... G09G 3/3696; G09G 2310/0291; G09G 2310/0294; G09G 2310/08; G09G 2310/0289
See application file for complete search history.

(56) References Cited

U.S. PATENT DOCUMENTS

2007/0040260 A1 2/2007 Otremba
2015/0137875 A1* 5/2015 Ko ..... H01L 23/5286 327/535

FOREIGN PATENT DOCUMENTS

KR 10-2018-0009009 A 1/2018

* cited by examiner

*Primary Examiner* — Andrew Sasinowski
(74) *Attorney, Agent, or Firm* — Harness, Dickey & Pierce, P.L.C.

(57) ABSTRACT

Disclosed herein is a driver integrated circuit (IC), which can be miniaturized and includes a plurality of circuits, including a first substrate, a first circuit driven at a first level voltage and mounted on the first substrate, a second substrate bonded to the first substrate, and a second circuit including one or more sub-circuits driven at a second level voltage that is higher than the first level voltage, wherein at least one among the one or more sub-circuits is mounted on the second substrate.

5 Claims, 9 Drawing Sheets

DRIVER INTEGRATED CIRCUIT AND DISPLAY DRIVING DEVICE INCLUDING THE SAME

CROSS-REFERENCE TO RELATED APPLICATIONS

This application claims the benefit of the Korean Patent Applications No. 10-2019-0172904 filed on Dec. 23, 2019, which are hereby incorporated by reference as if fully set forth herein.

FIELD

The present disclosure relates to a driver integrated circuit (IC).

BACKGROUND

As the information society develops, the demands for display devices for displaying images are increasing in various forms. Accordingly, recently, various types of display devices, such as liquid crystal display (LCD) devices or organic light emitting display (OLED) devices, have been used.

The display device includes a display panel and a driver integrated circuit (IC). The display panel includes a plurality of pixels arranged in a matrix form, and each pixel includes red (R), green (G), and blue (B) sub-pixels. In addition, each pixel or each sub-pixel emits light in grayscale according to an image, and thus the image is displayed on an entirety of the display panel.

Image data indicating a grayscale value of each pixel or each sub-pixel is transmitted to the display panel through the driver IC.

FIG. 1 is a plan view illustrating a structure of a conventional driver IC. As shown in FIG. 1, the driver IC 1 includes a first circuit 3 driven at a first level voltage, a second circuit 4 driven at a second level voltage, and a third circuit 5 driven at a third level voltage, which are formed in one substrate 2. In this case, the first level voltage means a low voltage, the second level voltage means a middle voltage, and the third level voltage means a high voltage.

Recently, according to the demand for miniaturization of the driver IC 1, an area X-Y of the driver IC 1 is required to be reduced. As functions of the circuits 3 to 5 become more complicated, it is difficult to reduce the sizes of the circuits 3 to 5, and thus there is a problem of having a limitation in reducing the size of the driver IC 1.

SUMMARY

Accordingly, the present disclosure is directed to a driver integrated circuit (IC), which may be miniaturized, and a display device including the same.

The present disclosure is also directed to a driver IC manufactured through a wafer-on-wafer process and a display device including the same.

According to an aspect of the present disclosure, there is provided a driver IC including a plurality of circuits, which includes a first substrate, a first circuit driven at a first level voltage and mounted on the first substrate, a second substrate bonded to the first substrate, and a second circuit including one or more sub-circuits driven at a second level voltage that is higher than the first level voltage, wherein at least one among the one or more sub-circuits is mounted on the second substrate.

According to an aspect of the present disclosure, there is provided a display driving device including a first substrate, a second substrate bonded to the first substrate, a first circuit configured to receive first image data from an external system, convert the first image data into second image data so as to allow the second image data to be displayed on a display panel, and sample the second image data, and a second circuit configured to convert the sampled second image data into a source signal and output the source signal to a data line of the display panel, wherein the first circuit and the second circuit are divided and mounted on the first substrate and the second substrate.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain the principle of the disclosure. In the drawings.

DETAILED DESCRIPTION

Figure 1:
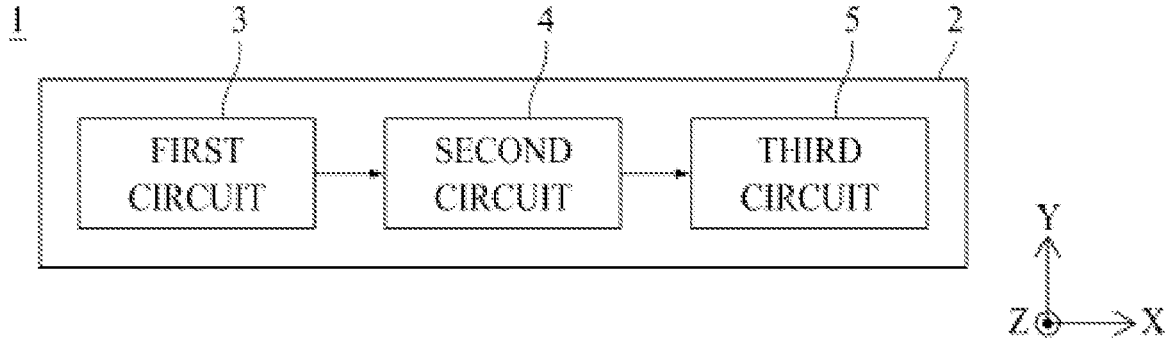
FIG. 1 is a plan view illustrating a structure of a conventional driver integrated circuit (IC)

Hereinafter, exemplary embodiments of the present disclosure will be described in more detail with reference to the accompanying drawings.

In the specification, it should be noted that like reference numerals already used to denote like elements in other drawings are used for elements wherever possible. In the following description, when a function and a configuration known to those skilled in the art are irrelevant to the essential configuration of the present disclosure, their detailed descriptions will be omitted. The terms described in the specification should be understood as follows.

Advantages and features of the present disclosure, and implementation methods thereof will be clarified through following embodiments described with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Further, the present disclosure is only defined by scopes of claims.

A shape, a size, a ratio, an angle, and a number disclosed in the drawings for describing embodiments of the present disclosure are merely an example, and thus, the present disclosure is not limited to the illustrated details. Like reference numerals refer to like elements throughout. In the following description, when the detailed description of the relevant known function or configuration is determined to unnecessarily obscure the important point of the present disclosure, the detailed description will be omitted.

In a case where 'comprise', 'have', and 'include' described in the present specification are used, another part may be added unless 'only' is used. The terms of a singular form may include plural forms unless referred to the contrary.

In construing an element, the element is construed as including an error range although there is no explicit description.

In describing a position relationship, for example, when a position relation between two parts is described as 'on~', 'over~', 'under~', and 'next~', one or more other parts may be disposed between the two parts unless 'just' or 'direct' is used.

In describing a time relationship, for example, when the temporal order is described as 'after~', 'subsequent~', 'next~', and 'before~', a case which is not continuous may be included unless 'just' or 'direct' is used.

It will be understood that, although the terms "first", "second", etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

An X axis direction, a Y axis direction, and a Z axis direction should not be construed as only a geometric relationship where a relationship therebetween is vertical, and may denote having a broader directionality within a scope where elements of the present disclosure operate functionally.

The term "at least one" should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item.

Features of various embodiments of the present disclosure may be partially or overall coupled to or combined with each other, and may be variously inter-operated with each other and driven technically as those skilled in the art can sufficiently understand. The embodiments of the present disclosure may be carried out independently from each other, or may be carried out together in co-dependent relationship.

Figure 2:
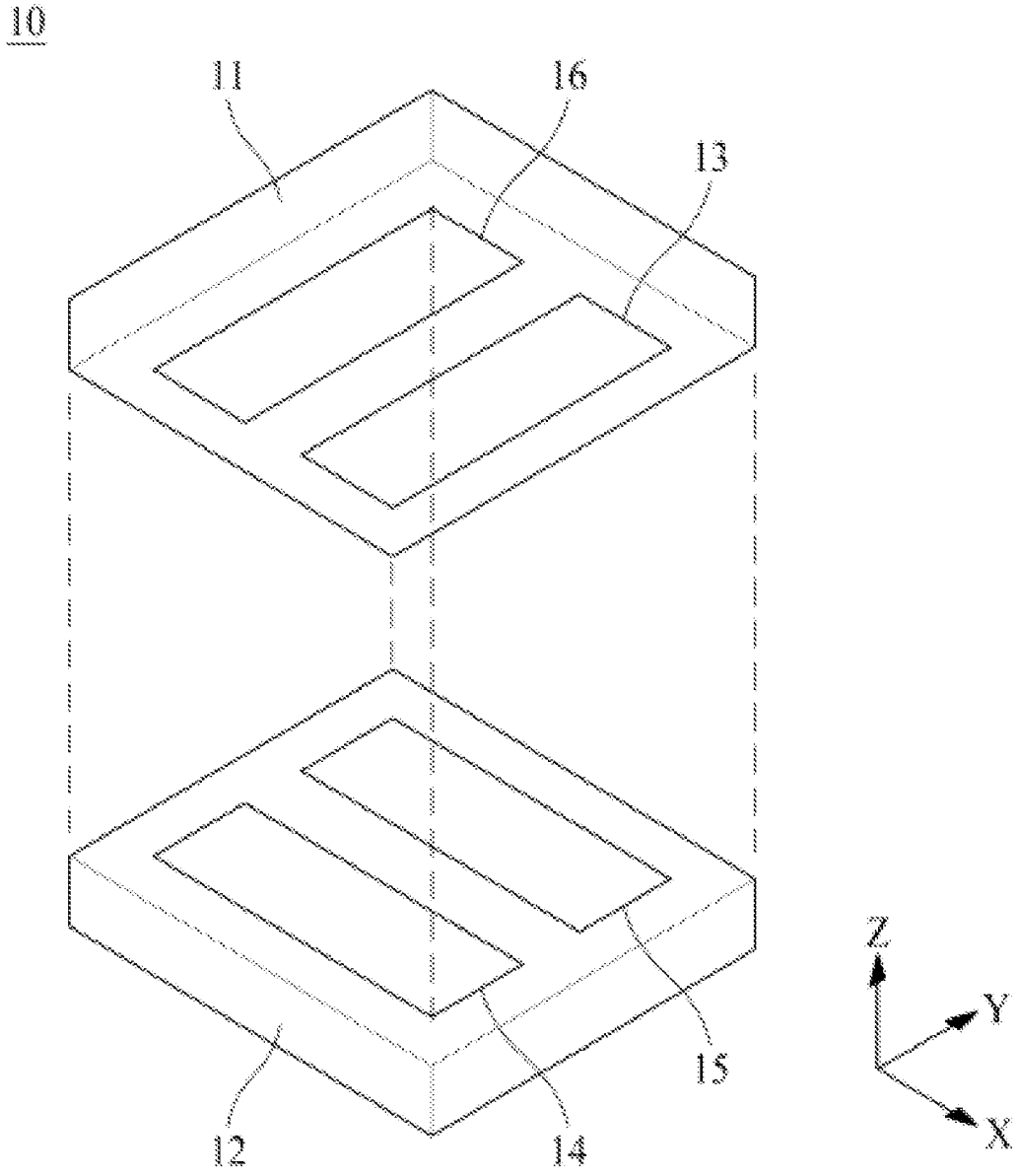
FIG. 2 is a schematic block diagram illustrating a structure of a driver IC (10) according to one embodiment of the present disclosure.

FIG. 2 is a schematic block diagram illustrating a structure of a driver integrated circuit (IC) 10 according to one embodiment of the present disclosure. As shown in FIG. 2, the driver IC 10 according to one embodiment of the present disclosure includes a first substrate 11, a second substrate 12, a first circuit 13, and a second circuit 14. In addition, as shown in FIG. 2, the driver IC 10 may further include a third circuit 15.

The first circuit 13 is mounted on the first substrate 11. In one embodiment, the first circuit 13 may be mounted on a first surface of the first substrate 11. In this case, the first surface means a surface facing the second substrate 12.

The second circuit 14 is mounted on the second substrate 12. The second substrate 12 is bonded to the first substrate 11. In one embodiment, the second circuit 14 may be mounted on a first surface of the second substrate 12. In this case, the first surface means a surface facing the first substrate 11.

The third circuit 15 is mounted on the second substrate 12. In one embodiment, the third circuit 15 may be mounted on the first surface of the second substrate 12.

In this case, the first surface of the first substrate 11 and the first surface of the second substrate 12 may be bonded using any one method among a wire bonding method using a wire, a flip chip bonding method using bumps for connection, and a through silicon via (TSV) bonding method.

The first circuit 13 is driven at a first level voltage. In this case, the first level voltage may mean a low voltage. In one embodiment, the first circuit 13 may be formed on the first surface of the first substrate 11.

In one embodiment, the first circuit 13 may include at least one first sub-circuit.

The second circuit 14 is driven at a second level voltage. In this case, the second level voltage may be a voltage that is higher than the first level voltage and may mean a middle voltage. In one embodiment, the second circuit 14 may be formed on the first surface of the second substrate 12.

In one embodiment, the second circuit 14 may include at least one second sub-circuit. When the second circuit 14 includes a plurality of second sub-circuits, at least one among the plurality of second sub-circuits may be mounted on the second substrate 12 and the remaining second sub-circuits may be mounted on the first substrate 11. Although the second circuit 14 has been illustrated as being formed on the second substrate 12 in FIG. 2, this is merely exemplary, and the present disclosure is not limited thereto.

In this case, the number of second sub-circuits to be mounted on the first substrate 11 may be set to be proportional to a size of a surplus area after the first circuit 13 is mounted on the first substrate 11. For example, when a size of a dummy area 16 remaining after the first circuit 13 is mounted on the first substrate 11 is less than or equal to a first reference value, it is determined that all of the second sub-circuits are to be mounted on the second substrate 12. Alternatively, when the size of the dummy area 16 remaining after the first circuit 13 is mounted on the first substrate 11 is greater than the first reference value and is smaller than a second reference value, at least one among the second sub-circuits may be mounted on the first substrate 11 and all the remaining second sub-circuits may be mounted on the second substrate 12. When the size of the dummy area 16 is greater than the second reference value, only the number of the second sub-circuits that is less than or equal to a reference number may be mounted on the second substrate 12 and the remaining number of the second sub-circuits may be mounted on the first substrate 11.

As described in the above embodiment, the second circuit 14 may be formed on only the second substrate 12, and alternatively, the second circuit 14 may be divided and formed on the first substrate 11 and the second substrate 12.

Figure 3:
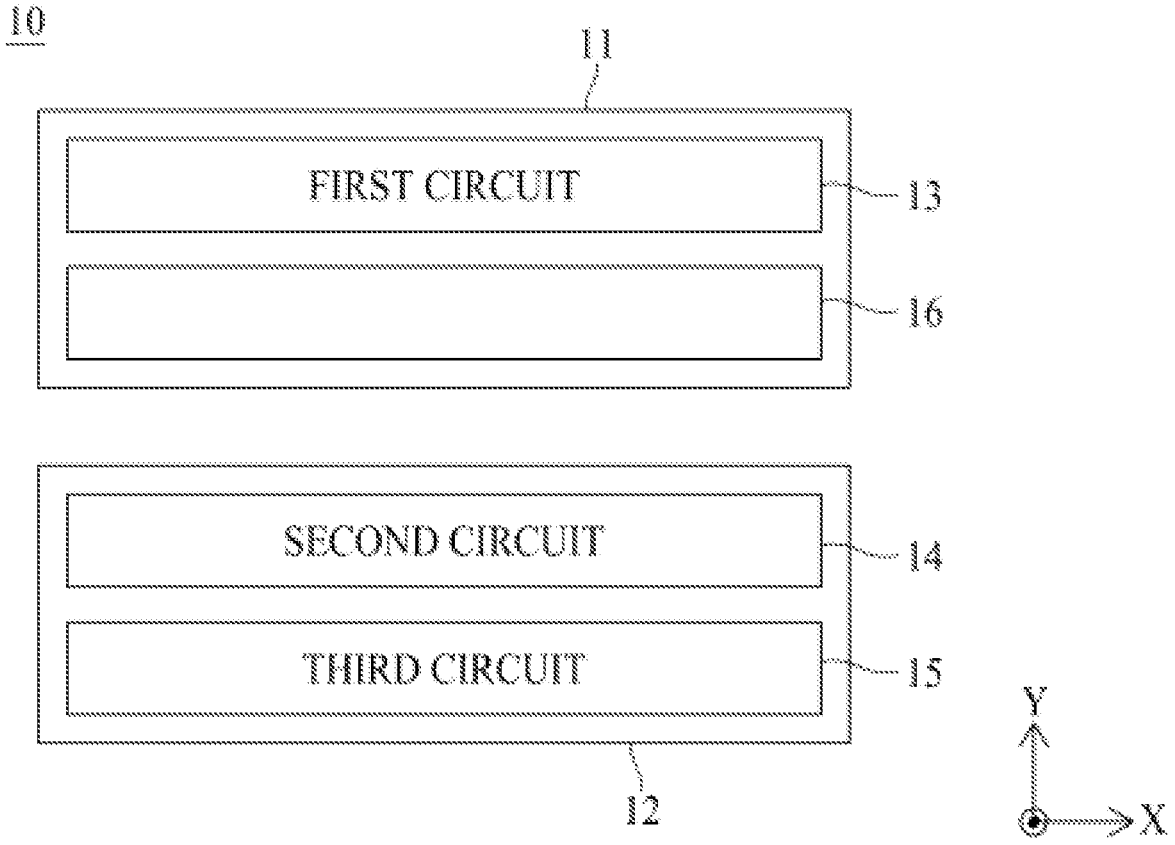
FIG. 3 is a diagram illustrating first surfaces, on which circuits are formed, of first and second substrates by disassembling the driver IC according to one embodiment of the present disclosure.
Figure 4:
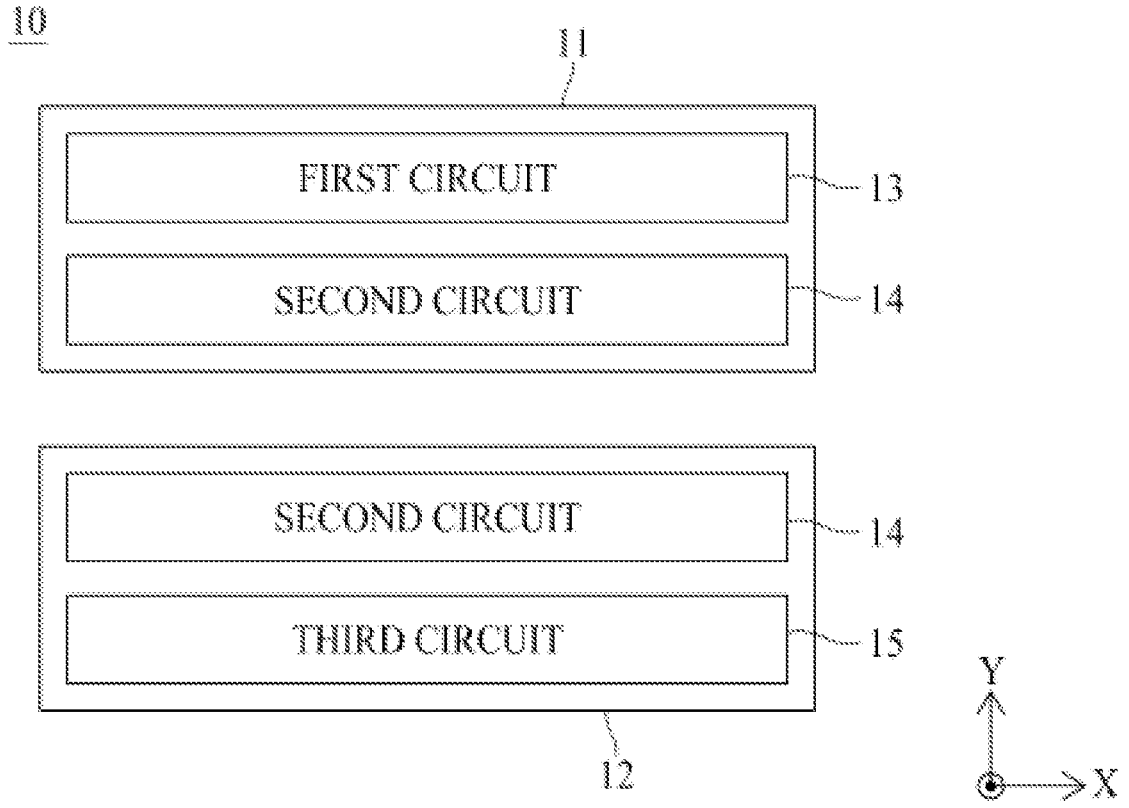
FIG. 4 is a diagram illustrating first surfaces, on which circuits are formed, of first and second substrates by disassembling a driver IC according to another embodiment of the present disclosure.

According to such an embodiment, as shown in FIGS. 3 and 4, the second circuit 14 may be formed. FIG. 3 is a diagram illustrating first surfaces, on which circuits are formed, of first and second substrates by disassembling the driver IC according to one embodiment of the present disclosure. FIG. 4 is a diagram illustrating first surfaces, on which circuits are formed, of first and second substrates by disassembling a driver IC according to another embodiment of the present disclosure.

As shown in FIG. 3, the second circuit 14 may be formed on only the second substrate 12. However, since only the first circuit 13 is formed on the first substrate 11, unlike the second substrate 12 on which the second circuit 14 and the third circuit 15 are formed, the dummy area 16 may be formed on the first substrate 11.

Specifically, in order to bond the first substrate 11 and the second substrate 12, areas X-Y of the first substrate 11 and the second substrate 12 should be the same. Thus, since the second circuit 14 and the third circuit 15 are formed on the second substrate 12 but only the first circuit 13 is formed on the first substrate 11, the dummy area 16 may be formed in the first substrate 11. Owing to the dummy area 16, a size of the driver IC 10 is increased.

Thus, according to another example of the present disclosure, when the second circuit 14 includes a plurality of second sub-circuits, in the driver IC 10, the second circuit 14 is divided and formed on the first substrate 11 and the second substrate 12.

As shown in FIG. 4, the second circuit 14 may be divided and formed on the first substrate 11 and the second substrate 12. At least one among the plurality of sub-circuits constituting the second circuit 14 is formed on the second substrate 12, and the remaining sub-circuits are formed on the first substrate 11.

Referring to FIG. 2 again, the third circuit 15 is driven at a third level voltage. In this case, the third level voltage may be a voltage that is higher than the first level voltage, and the second level voltage and may mean a high voltage. In one embodiment, the third circuit 15 may include at least one third sub-circuit.

In the above-described embodiment, the first to third circuits 13 to 15 are electrically connected to process data.

In one embodiment, the driver IC 10 shown in FIG. 2 may be a driver IC for a display. In this case, the driver IC 10 may be a data driving circuit. In this case, the driver IC 10 may include the first circuit 13 and the second circuit 14, the first circuit 13 may include a shift register circuit and a latch circuit, and the second circuit 14 may include a level shifter circuit, a digital-to-analog converter circuit, and an output buffer circuit.

Alternatively, the driver IC 10 may be a driver IC for a mobile display. In this case, a timing controller, a data driving circuit, and a gate driving circuit may be integrally formed in the driver IC 10. In this case, the driver IC 10 includes a first circuit 13 and a second circuit 14. The first circuit 13 may include the timing controller, a shift register circuit of the data driving circuit, and a latch circuit of the data driving circuit, and the second circuit may include a level shifter circuit, a digital-to-analog converter circuit, and an output buffer circuit. In addition, the driver IC 10 may further include a third circuit 15, and the third circuit 15 may include the gate driving circuit.

Meanwhile, the driver IC 10 according to the present disclosure may be manufactured through a wafer-on-wafer process. When compared with the manufacturing using a single wafer, in the present disclosure, since the circuits of the driver IC 10 are divided and formed on the first and second substrates and manufactured by bonding the first and second substrates, there is an effect in that the number of required masks is reduced so that a production cost is reduced.

As described above, since the driver IC 10 according to the present disclosure is manufactured through a wafer-on-wafer process, circuits are divided and formed on the two substrates.

In particular, since the driver IC 10 according to the present disclosure includes circuits which are driven at different level voltages, the circuits are not formed on a single substrate but are divided and formed on the first substrate and the second substrate according to a driving voltage of each circuit.

In addition, for an electrical connection between the circuits, the driver IC 10 according to the present disclosure is formed such that the first surface of the first substrate and the first surface of the second substrate, on which the circuits driven at different level voltages are formed, are bonded to face each other.

Hereinafter, an example case in which the driver IC according to the present disclosure is applied to a driver IC for a mobile display will be described.

Figure 5:
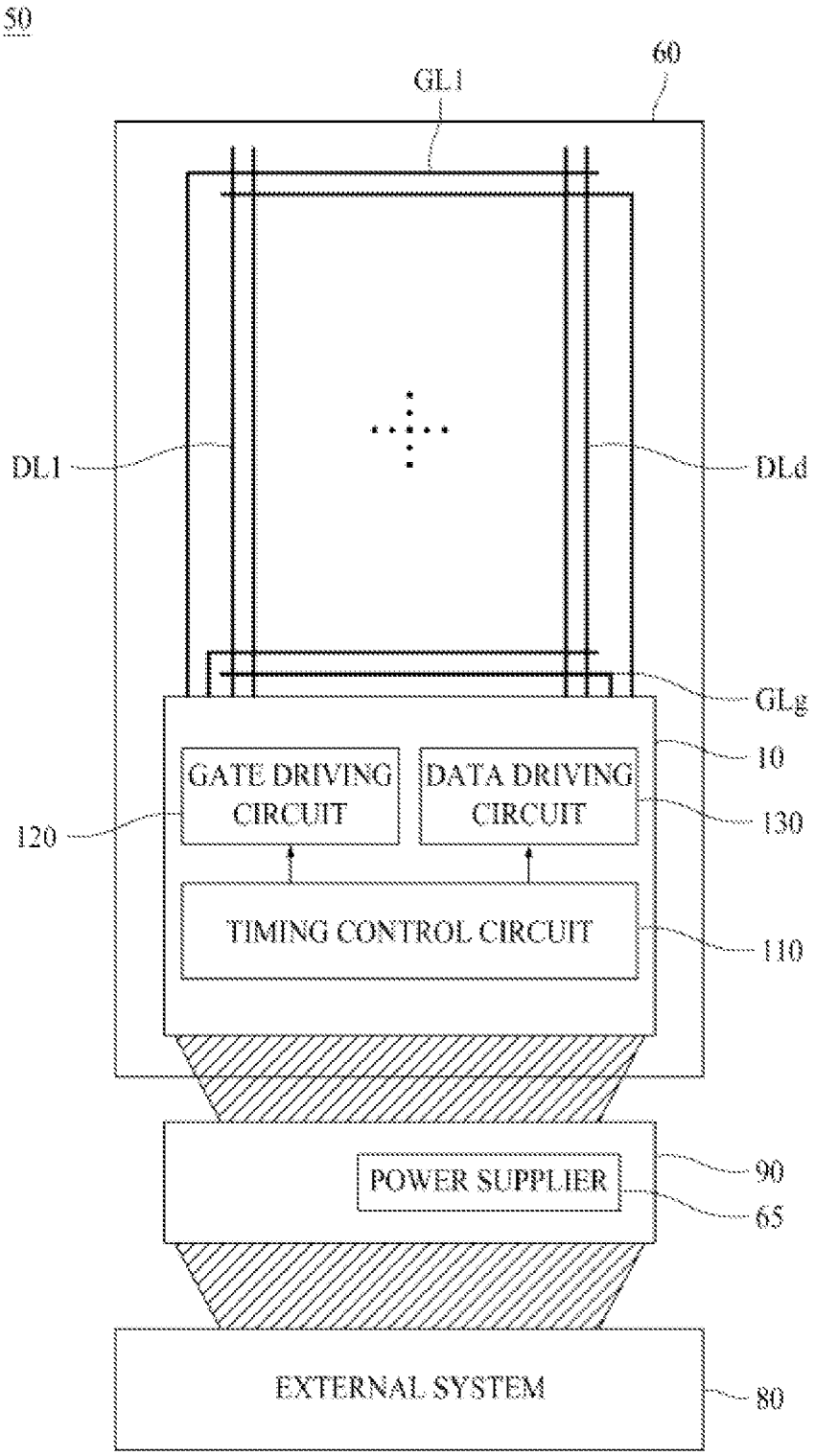
FIG. 5 is a diagram illustrating a display device to which the driver IC according to one embodiment of the present disclosure is applied.

FIG. 5 is a diagram illustrating a display device to which the driver IC according to one embodiment of the present disclosure is applied. A display device 50 according to the present disclosure includes a display panel 60, a power supplier 65, and an external system 80. In addition, the display device 50 according to the present disclosure includes the driver IC 10.

The display panel 60 may be an organic light-emitting panel in which an organic light-emitting device is formed or may be a liquid crystal panel in which a liquid crystal is formed. That is, all types of panels which are currently used may be applied as the display panel 60 applied to the present disclosure. Thus, the display device according to the present disclosure may also be an organic light-emitting display device, a liquid crystal display device, and various types of display devices in addition to the organic light-emitting display device and the liquid crystal display device. However, hereinafter, for convenience of description, a liquid crystal display device will be described as an example of the present disclosure.

Therefore, a case in which the display panel 60 is a liquid crystal panel will be described below as an example of the present disclosure.

When the display panel 60 is a liquid crystal panel, a plurality of data lines DL1 to DLd, a plurality of gate lines GL1 to GLg crossing the data lines DL1 to DLd, a plurality of thin film transistors (TFTs) formed at intersections of the data lines DL1 to DLd and the gate lines GL1 to GLg, a plurality of pixel electrodes for charging data voltages to pixels, and a common electrode for driving a liquid crystal charged in a liquid crystal layer together with the pixel electrodes are formed on a lower glass substrate of the display panel 60, and the pixels are disposed in the form of a matrix due to an intersection structure of the data lines DL1 to DLd and the gate lines GL1 to GLg.

A black matrix (BM) and a color filter are formed on an upper glass substrate of the display panel 60. A space between the lower glass substrate and the upper glass substrate is filled with the liquid crystal.

A liquid crystal mode of the display panel 60 applied to the present disclosure may include a twisted-nematic (TN) mode, a vertical alignment (VA) mode, an in-plane switching (IPS) mode, and a fringe-field switching (FFS) mode as well as any type of liquid crystal mode. In addition, the display device 50 according to the present disclosure may be implemented in any form such as a transmissive liquid crystal display, a semi-transmissive liquid crystal display, or a reflective liquid crystal display.

The display panel 60 displays an image in response to a gate signal and a source signal which are output from the driver IC 10.

The power supplier 65 is mounted on a main board 90 and supplies voltages for driving the display panel 60, the driver IC 10, and the external system 80. In this case, in addition to the power supplier 65, various circuit elements may be mounted on the main board 90.

The power supplier 65 generates voltages according to driving voltages of the circuits included in the driver IC 10 and supplies the voltages to the circuits. In this case, the driving voltages of the circuits of the driver IC 10 may include a first level voltage, a second level voltage, and a third level voltage. The first level voltage means a low voltage, the second level voltage means a middle voltage, and the third level voltage means a high voltage.

For example, the first level voltage may range from 0.9 V to 1.8 V, the second level voltage may be 8 V, and the third level voltage may be 25 V.

In addition, the power supplier 65 supplies power for driving the display panel 60 to the display panel 60 so as to allow the display panel 60 to operate.

The driver IC 10 may include a timing control circuit 110 for controlling a gate driving circuit 120 and a data driving circuit 130 which are formed in the display panel 60, the gate driving circuit 120 for controlling signals input to the gate lines GL1 to GLg, and the data driving circuit 130 for controlling signals input to the data lines DL1 to DLd formed in the display panel 60.

In this case, although the driver IC 10 has been illustrated as being mounted on the display panel 60 in FIG. 5, this is merely exemplary, and the driver IC 10 may be separated from the display panel 60 and mounted on the display panel 60 through a separate board.

In addition, as shown in FIG. 5, the timing control circuit 110, the gate driving circuit 120, and the data driving circuit 130 constituting the driver IC 10 may be formed as a single chip package or may be individually formed.

Hereinafter, each component of the driver IC 10 will be described in more detail with reference to FIG. 6.

Figure 6:
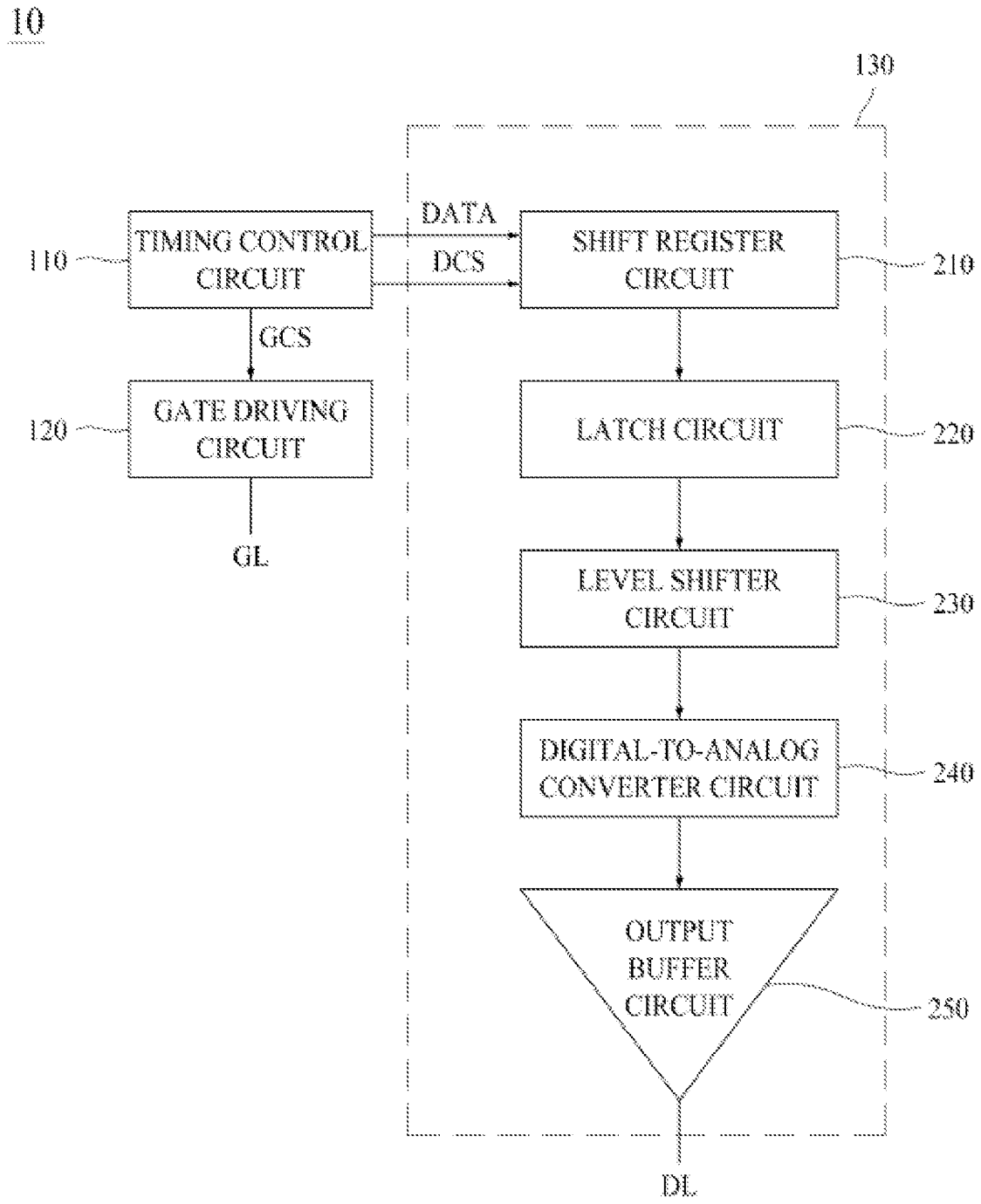
FIG. 6 is a diagram illustrating circuits constituting the driver IC (10) according to one embodiment of the present disclosure.

FIG. 6 is a diagram illustrating circuits constituting the driver IC 10 according to one embodiment of the present disclosure.

As shown in FIG. 6, the timing control circuit 110 supplies a gate control signal GCS to the gate driving circuit 120 to control the gate driving circuit 120. Specifically, the timing control circuit 110 receives first image data and timing signals from the external system 80. The timing control circuit 110 generates the gate control signal GCS for controlling the gate driving circuit 120 according to the timing signal and generates a data control signal DCS for controlling the data driving circuit 130.

In one embodiment, the timing control circuit 110 generates the gate control signal GCS including a gate start pulse (GSP), a gate shift clock (GSC), and a gate output enable (GOE) signal.

In one embodiment, the timing control circuit 110 generates the data control signal DCS including a source start pulse (SSP), a source sampling clock (SSC), and a source output enable (SOE) signal.

The timing control circuit 110 transmits the gate control signal GCS to the gate driving circuit 120 and transmits the data control signal DCS to the data driving circuit 130.

The timing control circuit 110 arranges the first image data received from the external system 80. Specifically, the timing control circuit 110 generates second image data by arranging the first image data according to a structure and a characteristic of the display panel 60.

The timing control circuit 110 transmits the second image data to the data driving circuit 130.

The gate driving circuit 120 outputs gate signals, which are synchronized with source signals generated by the data driving circuit 130, to the gate lines GL1 to GLg according to timing signals generated by the timing control circuit 110. Specifically, the gate driving circuit 120 outputs the gate signals, which are synchronized with the source signals, to the gate line GL1 to GLg according to the GSP, the GSC, and the GOE signal which are generated by the timing control circuit 110.

The gate driving circuit 120 includes a gate shift register circuit, a gate level shifter circuit, and the like. In this case, the gate shift register circuit may be directly formed on a TFT array substrate of the display panel 60 through a gate-in-panel (GIP) process. In this case, the gate driving circuit 120 supplies the GSP and the GSC to the gate shift register circuit formed on the TFT array substrate through the GIP process.

The data driving circuit 130 converts the second image data into a source signal according to the timing signal generated by the timing control circuit 110. Specifically, the data driving circuit 130 converts the second image data into the source signal according to the SSP, the SSC, and the SOE signal. The data driving circuit 130 outputs the source signal corresponding to one horizontal line to the data lines DL1 to DLd at every one horizontal period in which the gate signal is supplied to the gate line.

In this case, the data driving circuit 130 may receive a gamma voltage from a gamma voltage generator (not shown) and convert the second image data into the source signal using the gamma voltage.

To this end, as shown in FIG. 6, the data driving circuit 130 includes a shift register circuit 210, a latch circuit 220, a level shifter circuit 230, and a digital-to-analog converter circuit 240, and an output buffer circuit 250.

The shift register circuit 210 receives the SSP and the SSC from the timing control circuit 110 and sequentially shifts the SSP according to the SSC to output a sampling signal. The shift register circuit 210 transmits the sampling signal to the latch circuit 220.

The latch circuit 220 sequentially samples and latches the second image data by a predetermined unit according to the sampling signal. The latch circuit 220 transmits the latched second image data to the level shifter circuit 230.

The level shifter circuit 230 amplifies a level of the latched second image data. Specifically, the level shifter circuit 230 amplifies the level of the second image data to a level which allows the digital-to-analog converter circuit 240 to be driven. The level shifter circuit 230 transmits the second image data of which the level is amplified to the digital-to-analog converter circuit 240.

The digital-to-analog converter circuit 240 converts the second image data into the source signal which is an analog signal. The digital-to-analog converter circuit 240 transmits the source signal, which is converted into an analog signal, to the output buffer circuit 250.

The output buffer circuit 250 outputs the source signal to the data line. Specifically, the output buffer circuit 250 buffers the source signal according to the SOE signal generated by the timing control circuit 110 and outputs the buffered source signal to the data line.

Hereinafter, when the driver IC according to the present disclosure is applied to a driver IC for a mobile display, the structure of the driver IC 10 will be described in more detail with reference to FIG. 7.

Figure 7:
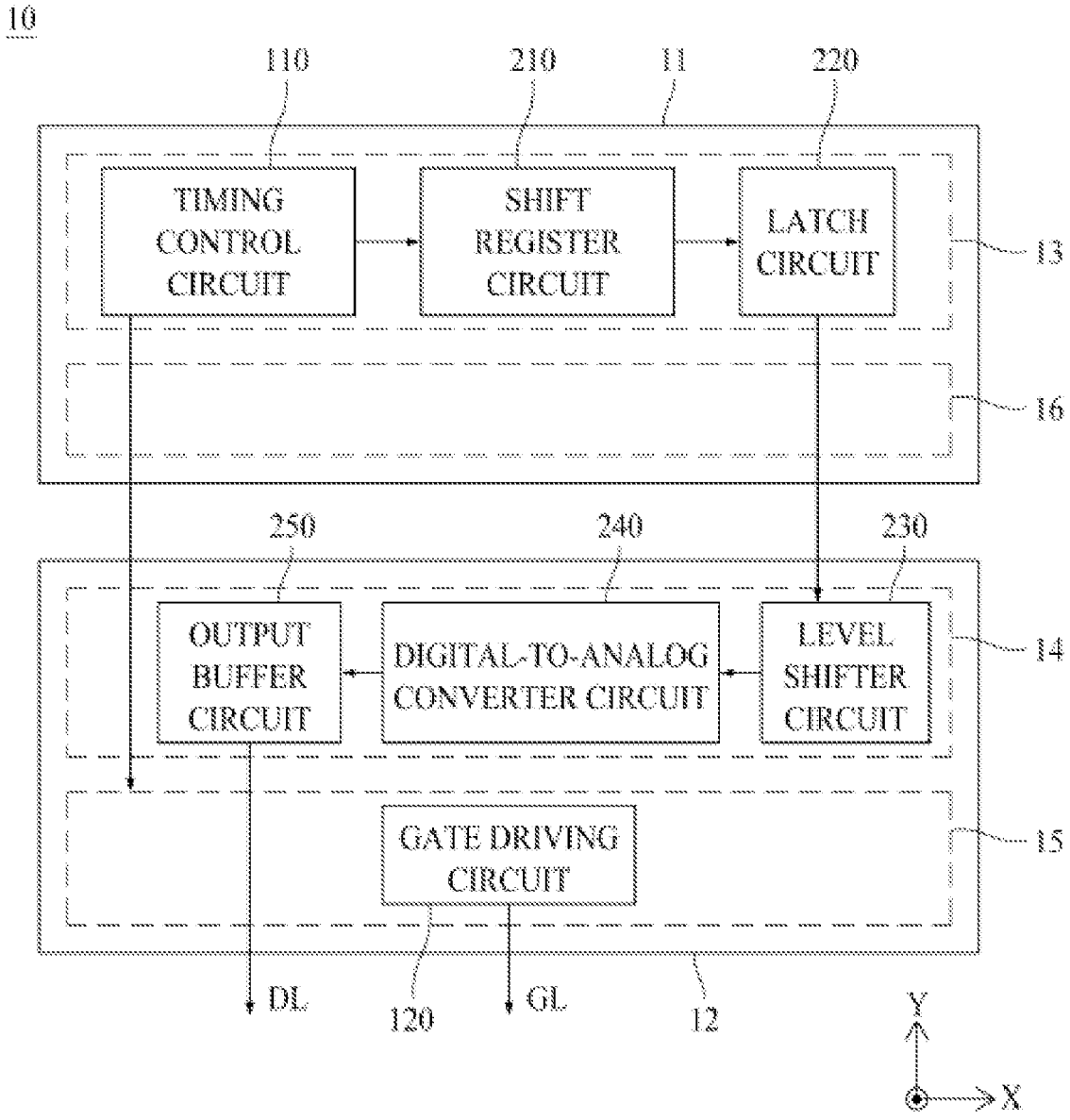
FIG. 7 is a plan view illustrating the first surface of each substrate by disassembling the first substrate and the second substrate of the driver IC according to one embodiment of the present disclosure.

FIG. 7 is a plan view illustrating the first surface of each substrate by disassembling the first substrate and the second substrate of the driver IC applied to a mobile display according to one embodiment of the present disclosure.

As shown in FIG. 7, the driver IC 10 according to the present disclosure includes the first substrate 11, the second substrate 12, the first circuit 13, the second circuit 14, and the third circuit 15.

The first circuit 13 is formed on the first surface of the first substrate 11. The first substrate 11 is bonded to the second substrate 12. Specifically, the first surface of the first substrate 11 is bonded to face the first surface of the second substrate 12.

The second circuit 14 and the third circuit 15 are formed on the first surface of the second substrate 12. The second substrate 12 is bonded to the first substrate 11. Specifically, the first surface of the second substrate 12 is bonded to face the first surface of the first substrate 11.

In this case, the bonding of the first substrate 11 and the second substrate 12 may be made using a method such as a wire bonding method using a wire, a flip chip bonding method using bumps for connection, or a method of forming a TSV.

The first circuit 13 is formed on the first surface of the first substrate 11. The first circuit 13 is a circuit driven at a first level voltage. In this case, the first level voltage may mean a low voltage. For example, the first level voltage may range from 0.9 V to 1.8 V.

The first circuit 13 is electrically connected to the second circuit 14 and the third circuit 15.

In one embodiment, the first circuit 13 may include a logic circuit.

In one embodiment, the first circuit 13 may include the timing control circuit 110, the shift register circuit 210 of the data driving circuit 130, and the latch circuit 220 of the data driving circuit 130. As described above, the timing control circuit 110, the shift register circuit 210, and the latch circuit 220 are driven at the first level voltage.

According to the above embodiment, the first circuit 13 receives the first image data from the external system 80 and converts the first image data into the second image data to sample the second image data, thereby allowing the second image data to be displayed on the display panel.

The second circuit 14 is formed on the first surface of the second substrate 12. The second circuit 14 is a circuit which is driven at the second level voltage. In this case, the second level voltage may be a level voltage that is higher than the first level voltage and may mean a middle voltage. For example, the second level voltage may be 8 V.

The second circuit 14 is electrically connected to the first circuit 13 and the third circuit 15.

In an embodiment, the second circuit 14 may include the level shifter circuit 230 of the data driving circuit 130, the digital-to-analog converter circuit 240 of the data driving circuit 130, and the output buffer circuit 250 of the data driving circuit 130.

According to the above embodiment, the second circuit 14 converts the second image data, which is sampled by the first circuit 13, into a source signal and outputs the source signal to the data line of the display panel.

The third circuit 15 is formed on the first surface of the second substrate 12. The third circuit 15 is a circuit which is driven at the third level voltage. In this case, the third level voltage may be a level voltage that is higher than the second level voltage and may mean a high voltage. For example, the third level voltage may be 25 V.

The third circuit 15 is electrically connected to the first circuit 13 and the second circuit 14.

In one embodiment, the third circuit 15 may include the gate driving circuit 120. According to the above embodiment, the third circuit 15 outputs a gate signal, which is synchronized with the source signal, to the gate line of the display panel.

As described above, in the driver IC 10 according to the present disclosure, the first to third circuits 13 to 15 are formed on the first substrate 11 and the second substrate 12 instead of a single substrate, and the first and second substrates 11 and 12 are bonded so that there is an effect in that the area X-Y of the driver IC 10 may be reduced.

However, in the above-described embodiment, the dummy area 16 is present in the first substrate 11 on which the first circuit 13 is formed. Thus, in another embodiment of the present disclosure, in order to reduce a size of a driver IC, at least one among a plurality of sub-circuits constituting a second circuit 14 is formed on a second substrate 12, and the remaining sub-circuits are formed in a dummy area 16 of a first substrate 11.

Hereinafter, a driver IC according to another embodiment of the present disclosure will be described in more detail with reference to FIG. 8. However, a detailed description of the same contents as the above description will be omitted herein.

Figure 8:
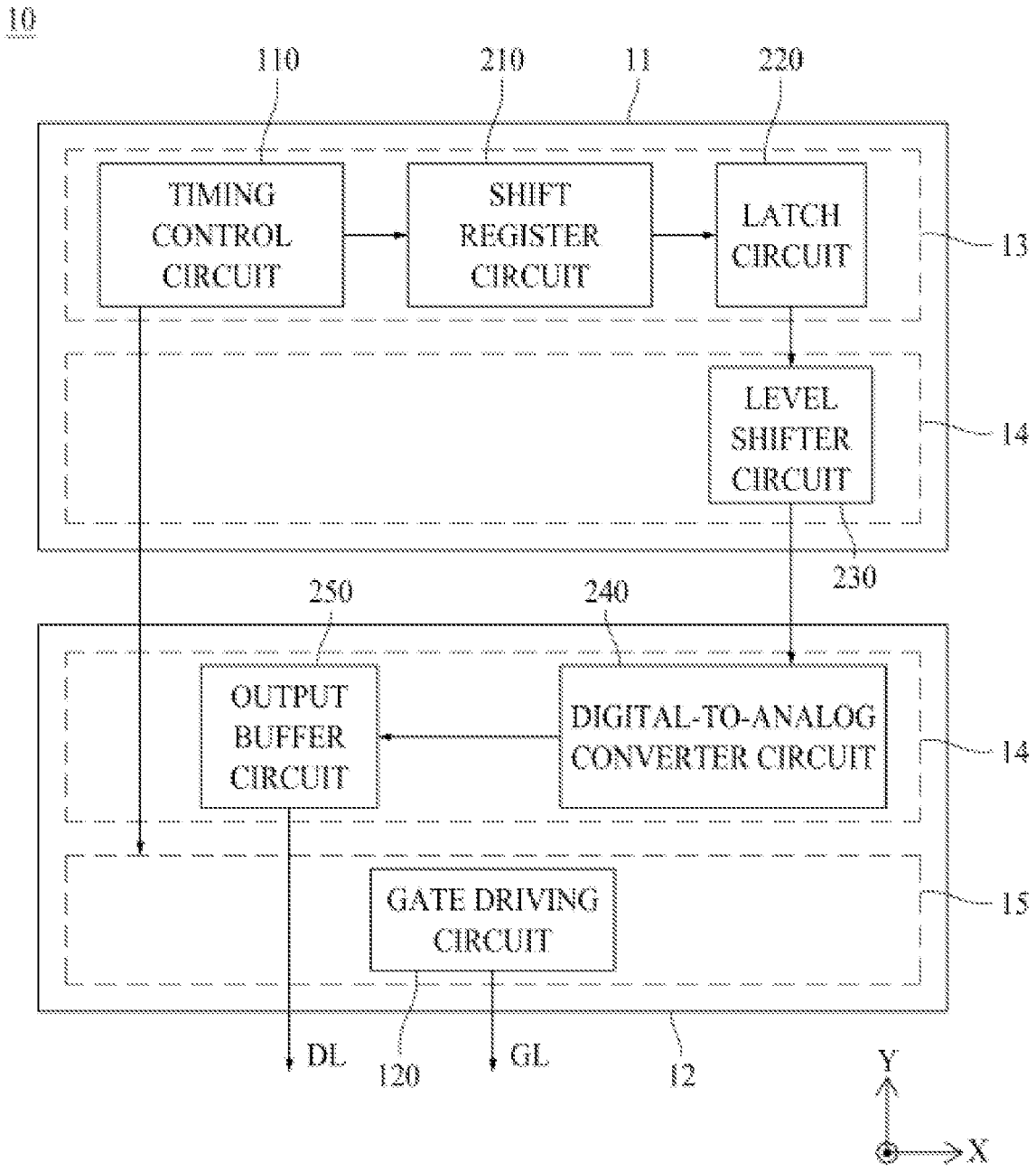
FIG. 8 is a plan view illustrating the first surface of each substrate by disassembling the first substrate and the second substrate of the driver IC according to another embodiment of the present disclosure.

FIG. 8 is a plan view illustrating a first surface of each substrate by disassembling a first substrate and a second substrate of the driver IC according to another embodiment of the present disclosure.

As shown in FIG. 8, a first circuit 13 is formed on a first surface of the first substrate 11. In addition, in a second circuit 14, at least one sub-circuit is formed on a first surface of a first substrate 11, and the remaining sub-circuits are formed on a first surface of a second substrate 12. In addition, the remaining sub-circuits of the second circuit 14 and a third circuit 15 are formed on the first surface of the second substrate 12.

For example, as shown in FIG. 8, a level shifter circuit 230 of the second circuit 14 may be formed on the first surface of the first substrate 11, and a digital-to-analog converter circuit 240 and an output buffer circuit 250 of the second circuit 14 may be formed on the first surface of the second substrate 12. Alternatively, unlike FIG. 8, the level shifter circuit 230 and the digital-to-analog converter circuit 240 of the second circuit 14 may be formed on the first surface of the first substrate 11, and the output buffer circuit 250 may be formed in the second substrate 12.

As described above, since the second circuit 14 is divided and formed on the first substrate 11 and the second substrate 12 and thus the dummy area 16 formed in the first substrate 11 may be removed, sizes of the first substrate 11 and the second substrate 12 are reduced so that there is an effect in that an overall size of the driver IC 10 may also be reduced.

That is, in the second circuit 14, at least one sub-circuit is formed on the first surface of the second substrate 12, and the remaining sub-circuits are formed on the first surface of the first substrate 11.

In the above-described one embodiment and another embodiment, the timing control circuit 110, the data driving circuit 130, and the gate driving circuit 120 have been described as being implemented as a single driver IC 10. However, as described above, each of the timing control circuit 110, the gate driving circuit 120, and the data driving circuit 130 may be implemented as a separate driver IC.

In this case, a case in which the data driving circuit 130 is implemented as a separate driver IC 10 will be described with reference to FIG. 9.

Figure 9:
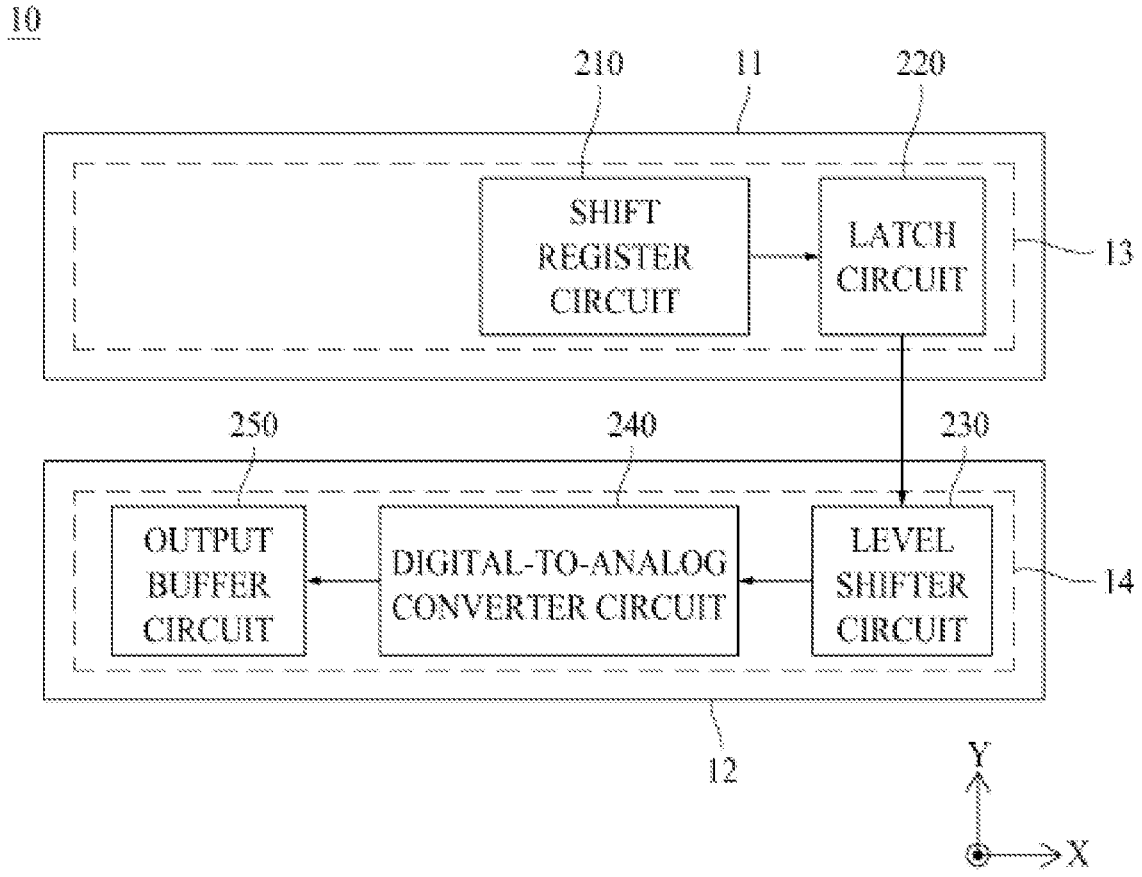
FIG. 9 is a plan view illustrating the first surface of each substrate by disassembling the first substrate and the second substrate of the driver IC when a data driving circuit is implemented as a separate driver IC.

FIG. 9 is a plan view illustrating, when a data driving circuit 130 is implemented as a separate driver IC 10, a first surface of each of a first substrate and a second substrate by disassembling the first substrate and the second substrate of the driver IC 10. As shown in FIG. 9, the driver IC 10 includes a first substrate 11, a second substrate 12, a first circuit 13, and a second circuit 14.

The first circuit 13 may be formed on the first surface of the first substrate 11. The first substrate 11 is bonded to the second substrate 12. Specifically, the first surface of the first substrate 11 may be bonded to face the first surface of the second substrate 12.

The second circuit 14 may be formed on the first surface of the second substrate 12. The second substrate 12 is bonded to the first substrate 11. Specifically, the first surface of the second substrate 12 may be bonded to face the first surface of the first substrate 11.

The first circuit 13 is formed on the first surface of the first substrate 11. The first circuit 13 is driven at a first level voltage.

As described above, the first circuit 13 includes a shift register circuit 210 of the data driving circuit 130 and a latch circuit 220 of the data driving circuit 130.

The second circuit 14 is formed on the first surface of the second substrate 12. The second circuit 14 is driven at a second level voltage that is higher than the first level voltage.

As described above, the second circuit 14 includes a level shifter circuit 230, a digital-to-analog converter circuit 240, and an output buffer circuit 250 of the data driving circuit 130.

In one embodiment, at least one among sub-circuits of the second circuit 14 may be formed on the first surface of the first substrate 11, and the remaining sub-circuits of the second circuit 14 may be formed on a second surface of the second substrate 12. All the sub-circuits of the second circuit 14 have been illustrated as being formed on the second substrate 12. Alternatively, at least one among sub-circuits of the second circuit 14 may be formed on the first substrate 11.

For example, the level shifter circuit 230 of the second circuit 14 may be formed on the first surface of the first substrate 11, and the digital-to-analog converter circuit 240 and the output buffer circuit 250 of the second circuit 14 may be formed on the first surface of the second substrate 12. Alternatively, the level shifter circuit 230 and the digital-to-analog converter circuit 240 of the second circuit 14 may be formed on the first surface of the first substrate 11, and the output buffer circuit 250 of the second circuit 14 may be formed on the first surface of the second substrate 12.

Referring to FIG. 5 again, the external system 80 transmits the first image data, which includes information on an image to be displayed on the display panel 60, and the timing signals to the driver IC 10.

The display device 50 according to the present disclosure may be a large terminal such as a television (TV) or a personal computer (PC) or may be a mobile terminal such as a smart phone, a mobile phone, a tablet PC.

When the display device 50 according to the present disclosure is a smart phone, the external system 80 may be a main chip, i.e., an application processor (AP), which receives voice or data by performing wireless communication with an external communication network.

In accordance with the present disclosure, circuits constituting a driver IC are divided and formed on two substrates, and the two substrates are bonded so that the driver IC can be miniaturized and there is an effect in that a bezel size of a display device on which the driver IC is mounted can be reduced.

In addition, in accordance with the present disclosure, since the driver IC is manufactured through a wafer-on-wafer process, the number of masks required for each wafer is reduced so that there is an effect in that a manufacturing cost of the driver IC can be minimized.

It will be apparent to those skilled in the art that various modifications can be made to the above-described exemplary embodiments of the present disclosure without departing from the spirit or scope of the disclosure. Thus, it is intended that the present disclosure covers all such modifications provided they come within the scope of the appended claims and their equivalents.

What is claimed is:

1. A driver integrated circuit (IC) including a plurality of circuits, comprising:

a first substrate;

a first circuit driven at a first level voltage and mounted on the first substrate;

a second substrate bonded to the first substrate;

a second circuit including one or more sub-circuits driven at a second level voltage that is higher than the first level voltage; and a third circuit driven at a third level voltage that is higher than the second level voltage and mounted on the second substrate, wherein at least one among the one or more sub-circuits is mounted on the second substrate.

2. The driver IC of claim 1, wherein the remaining sub-circuits among the one or more sub-circuits constituting the second circuit, excluding the sub-circuit mounted on the second substrate, are mounted on the first substrate.

3. The driver IC of claim 1, wherein:

the first circuit is formed on a first surface of the first substrate;

at least one among the one or more sub-circuits constituting the second circuit is formed on a first surface of the second substrate, and the remaining sub-circuits thereamong are formed on the first surface of the first substrate; and the first and second substrates are bonded such that the first surface of the first substrate faces the first surface of the second substrate.

4. The driver IC of claim 1, wherein the first substrate and the second substrate are bonded by any one among a wire bonding, a flip-chip bonding, and a through silicon via bonding.

5. The driver IC of claim 1 that is a driver IC for driving a display, which outputs an image signal to a display panel.

* * * * *